United States Patent [19]

Sakashita

[11] 4,290,333

[45] Sep. 22, 1981

[54] EXPRESSION MEANS OF ELECTRONIC MUSICAL INSTRUMENT

[75] Inventor: Masao Sakashita, Shobu, Japan

[73] Assignee: Kabushiki Kaisha Kawai Gakki Seisakusho, Hamamatsu, Japan

[21] Appl. No.: 120,034

[22] Filed: Feb. 11, 1980

[30] Foreign Application Priority Data

Feb. 24, 1979 [JP] Japan ..... 54-20921
Feb. 24, 1979 [JP] Japan ..... 54-20922

[51] Int. Cl.[3] ..... G10H 1/02; G10H 1/36

[52] U.S. Cl. ..... 84/1.24; 84/1.03; 84/1.17

[58] Field of Search ..... 84/1.01, 1.03, 1.09–1.13, 84/1.17, 1.19, 1.21, 1.24, 1.26, 1.27

[56] References Cited

U.S. PATENT DOCUMENTS 3,603,713 9/1971 Nakada ..... 84/1.19
3,848,142 11/1974 Adachi ..... 84/1.13 X

*Primary Examiner*—S. J. Witkowski

*Attorney, Agent, or Firm*—Sughrue, Mion, Zinn, Macpeak and Seas

[57] ABSTRACT

An expression means has been developed which can accentuate only a selected musical sound, e.g., melody, out of melody, accompaniment chord and bass sound generated in an electronic musical instrument and does not accentuate other sounds. The expression means of the present invention produces a first electric potential that will vary in response to an operation of an expression pedal and a second potential that will vary in response to a slow operation of the expression pedal though irresponsive to a quick operation of it. For gain control of amplifiers that deal with musical sounds required to be accentuated, said first potential is prepared, and for gain control of other amplifiers that deal with musical sounds free from accentuation, said second potential is prepared. Furthermore, the expression means of this invention employs changeover switches to realize arbitrary choice of the sounds to be accentuated.

4 Claims, 8 Drawing Figures

EXPRESSION MEANS OF ELECTRONIC MUSICAL INSTRUMENT

FIELD OF THE INVENTION

This invention relates to an expression circuit for electronic musical instrument which can accentuate a particular musical sound or sounds by a quick operation of an expression pedal.

This invention also relates to an expression circuit for electronic musical instruments equipped with a selection means that can be switched by the player at his own discretion in order to change the sort of musical sound to be accentuated.

DESCRIPTION OF THE PRIOR ART

Conventional electronic musical instruments are provided with an expression pedal for controlling the entire volumes of the musical sounds (including a melody generated with an upper key, an accompaniment chord generated with a lower key, and a bass sound generated with a pedal).

As is well known, such an electronic musical instrument provided with the expression pedal can control the volume of the musical sound by slowly pressing down and releasing of the pedal. In contrast, quickly pressing-and-releasing of the pedal will bring about an abrupt change of volume, thereby producing a so called accent. The conventional expression circuit, however, can not avoid giving the same inclinable accent to other musical sounds (accompaniment, bass) as well as to the desired particular musical sound, e.g., the melody desired to be accentuated. Therefore, this circuit has a disadvantage in that it is incapable of giving stress solely to a particular musical sound or sounds to enhance the performance effect.

SUMMARY OF THE INVENTION

An object of this invention is to provide an expression circuit, comparatively simple in construction, free from this disadvantage, and capable of giving an accent to a particular one of the melody, accompaniment chord and bass sound.

Another object of this invention is to provide an expression circuit having one or more switches that can be swithed to choose a particular sort of musical sound or sounds to be accentuated.

DETAILED DESCRIPTION OF THE INVENTION

Figure 1:
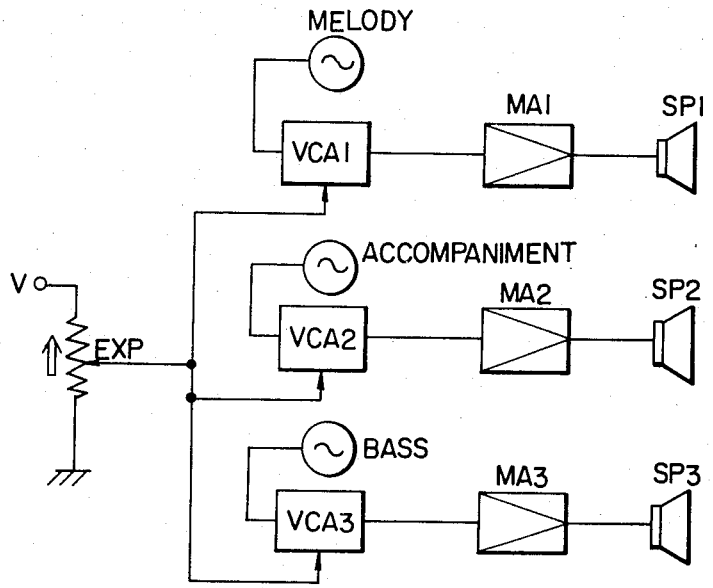
FIG. 1 (PRIOR ART)
FIG. 1 shows a conventional expression circuit for an electronic musical instrument.

In an expression circuit of the conventional electronic musical instrument shown in FIG. 1, voltage controlled amplifiers VCA1, VCA2 and VCA3 are supplied with control voltages derived from a variable resistor with a sliding tap EXP capable of travelling in accordance with the operation of an expression pedal. The musical sounds produced by operations of the upper key (for melody), lower key (for accompaniment chord) and foot pedal (for bass sound) respectively are gain controlled there and then amplified at main amplifiers MA1, MA2 and MA3 before application to the loudspeakers SP1, SP2 and SP3. In more detail, quickly pressing the expression pedal (not shown in the figure) causes rapid excursion of the sliding tap EXP in the arrow direction. In this case the outputs of voltage controlled amplifiers VCA1, VCA2 and VCA3 are given by the sound waveforms A, B and C shown in FIG. 2.

Figure 2:
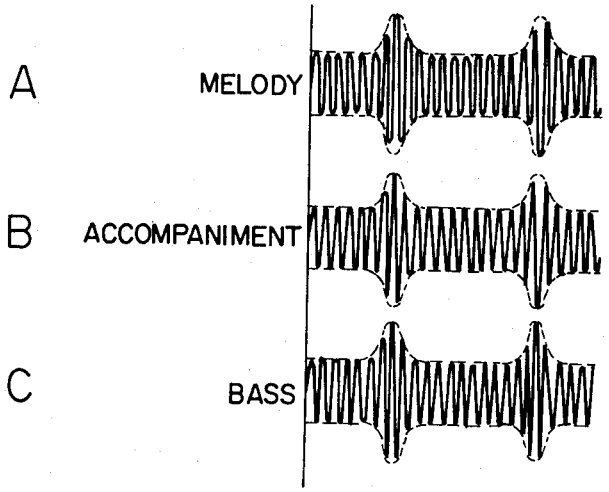
FIG. 2 (PRIOR ART)
FIG. 2 shows waveforms of the sounds accentuated by the circuit of FIG. 1.

In FIG. 2, it may be assumed that A shows a melody sound produced by an operation of upper key, B shows an accompaniment chord by lower key, and C shows a bass sound by foot pedal. Although the amplitudes of the sounds may be different from each other, it is clear that the trends of accentuation by the operation of expression pedal are exactly the same and the sound volumes are changing in the order of small - large - small, keeping step with each other. It is therefore impossible for the circuit of FIG. 1 to accentuate only a selected musical sound, for example melody part, and not the other musical sound (accompaniment chord and bass sound).

Figure 3:
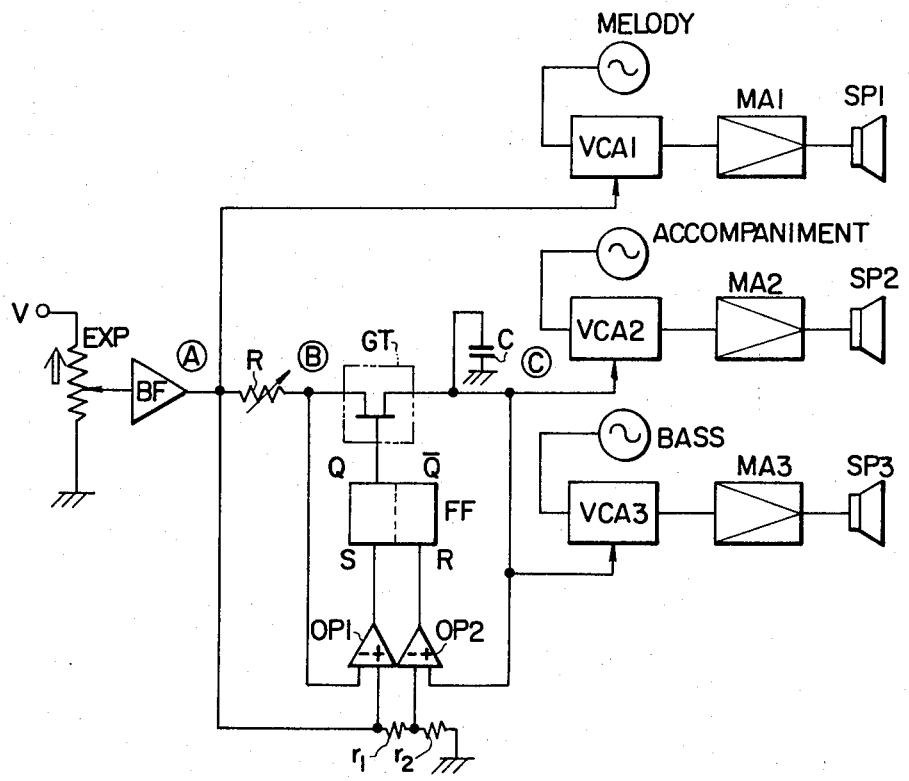
FIG. 3 is a drawing illustrating a circuit configuration of a first embodiment of this invention.
Figure 4:
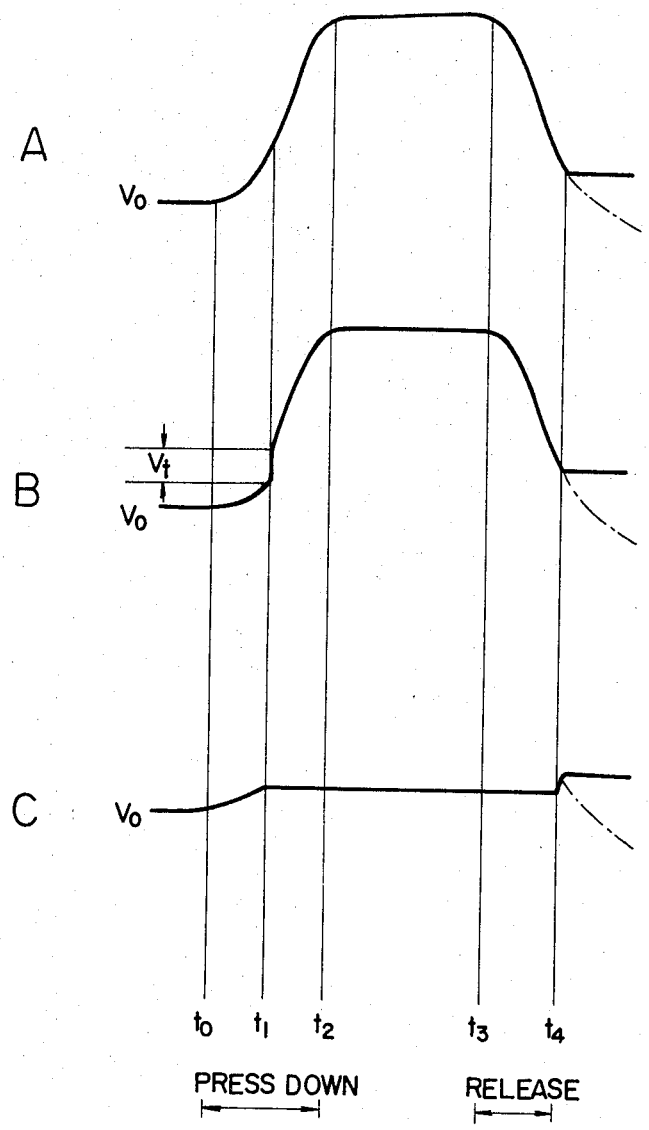
FIG. 4 is a drawing for use in the explanation of the instrument of FIG. 3.

FIG. 3 shows a circuit configuration of a first embodiment of this invention, and FIG. 4 is a time chart for use in explanation of operation. In FIG. 3, BF denotes a buffer amplifier, GT denotes a gate circuit, R and C denote a resistor and a charge-discharge capacitor, forming a time constant circuit, FF denotes a flip-flop, OP1 and OP2 denote operational amplifiers, and r1 and r2 denote resistors forming a voltage dividing circuit.

In the initial condition, the gate circuit GT is conductive, and the flip-flop FF is in reset state, or its Q side is in logic "0". As long as the gate circuit GT is conductive, the intermediate point Ⓑ and the output point Ⓒ of the time constant circuit are in the same potential. When this circuit is in steady state, said potential is equal to the potential or voltage at the input terminal Ⓐ of the time constant circuit. Those electric potentials or voltages are equal to the output voltage Vo of the buffer amplifier BF with its input associated with the sliding tap EXP being in a position defined by the expression pedal at the stand-still position.

FIG. 4 shows time variations of potentials at terminals Ⓐ, Ⓑ, and Ⓒ, where, time is indicated on the abscissa and $t_o$ is the starting time of pedal press down action. The potential at point Ⓐ rises as soon as the sliding tap EXP is moved in response to pressing the expression pedal, but the rising in potentials at points Ⓑ and Ⓒ are delayed by time constant RC, causing gradual increase of potential difference between points Ⓐ and Ⓑ. As the operational amplifier OP1 has (+) and (−) inputs supplied with the voltages at points Ⓐ and Ⓑ respectively, its input voltages are almost equal both before $t_o$ and for some time after $t_o$ and therefore provides no output.

When a potential difference Vt is obtained between the points Ⓐ and Ⓑ at the time $t_1$, the amplifier suddenly provides an output. At this moment, the flip-flop FF is set and gives logic "1" at the Q output so that the gate circuit GT becomes non-conductive. At the same time, charging current for capacitor Ⓒ is cut off, the electric potential at Ⓑ jumps to the level of potential at Ⓐ, and the potential at Ⓒ stops rising. Therefore, the potentials at Ⓐ and Ⓑ rise in such manner as to trace a common curve according to the amount of pressing subsequent to $t_1$, while the point Ⓒ remains at the voltage developed at the time $t_1$.

Figure 5:
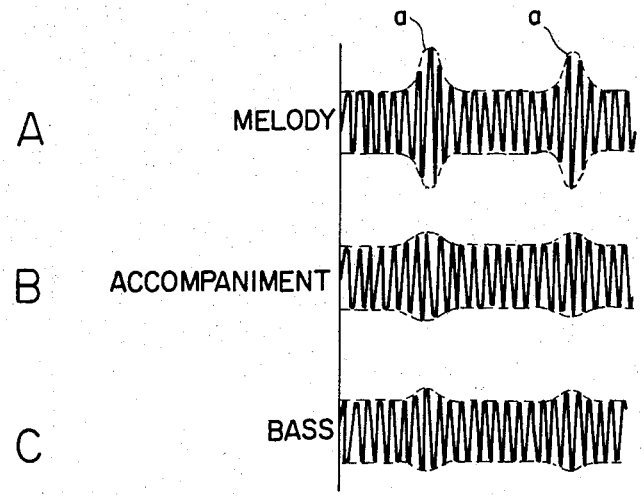
FIG. 5 shows waveforms in which one is accentuated by the instrument of FIG. 3 whereas the others are not accentuated.

The potentials at Ⓐ and Ⓑ stop rising at $t_2$ when the pressing of the expression pedal is completed. The pressing of expression pedal during the time between $t_o$ and $t_2$ provides a large change to VCA1 with the control voltage supplied from the point Ⓐ, thereby accentuating only the melody sound produced by the manipulation of upper key, as shown with mark "a" in FIG. 5A. In contrast, VCA2 and VCA3 with their control voltages fed from point Ⓒ are scarcely affected by voltage flutter due to the excursion of sliding tap EXP, or the operation of expression pedal. That means, the musical sounds (accompaniment chord and bass sound) other than the melody are scarcely accentuated as shown in FIG. 5, B and C.

At time $t_3$, when the release of the expression pedal starts, the potentials at Ⓐ and Ⓑ begin to go down along the same trend of curve, but the potential at Ⓒ remains unchanged for some time. When the potentials at Ⓐ and Ⓑ become a little higher than the potential at Ⓒ (time $t_4$), the operational amplifier OP2 with its inputs (−) and (+) supplied with a potential difference less than said Vt gives its output to reset the flip-flop FF, which turns the gate circuit GT into conductive again. At that time, the potential at Ⓒ becomes slightly higher to be equal to those at Ⓐ and Ⓑ.

The potentials provided by voltage dividers $r_1$, $r_2$ are so adjusted as to secure the conduction of the gate circuit GT even in case that the sliding tap EXP stops at a position that will give a little larger sound volume than the initial position does, when the released amount of the expression pedal is slightly less than the amount of the pressing down. The reason is that when the gate circuit GT remains in its nonconductive state, the potential at Ⓒ cannot be charged even in case the expression pedal is operated for usual purpose of sound volume control without accentuation as will be explained later.

When the released expression pedal travels beyond the original position, the potential at Ⓒ will rise slightly and then decrease along almost the same curve as those along which the potentials at Ⓐ and Ⓑ decrease as shown by a broken lines in FIG. 4. The potential at Ⓒ then stays at the output potential of the buffer BF determined by the position of stopped expression pedal, or the position of the sliding tap EXP. Thus, such performance can be realized as to accentuate only the melody sound and not the other musical sounds.

The reason why resistance R is variable is to determine whether a certain speed operation of expression pedal provides an accentuation or a mere volume control of all the musical sounds as is seen in the conventional circuit. That is, with a large resistance R, a relatively low speed operation makes it possible to accentuate only the melody sound and no other sounds. Conversely, with a relatively small resistance R, only a relatively high speed pedal operation can provide the exclusive accentuated melody sound, the other sounds not being accentuated.

The explanation so far is confined to the case that only the melody sound designated by upper key is accentuated, but obviously the embodiment of FIG. 3 has such construction that an accent is given to the musical sound applied to the voltage controlled amplifier connected to the point Ⓐ, therefore if the control terminal of the voltage controlled amplifier to which a musical sound other than the melody sound is applied is connected with point Ⓐ, the corresponding musical sound can be accentuated.

Figure 6:
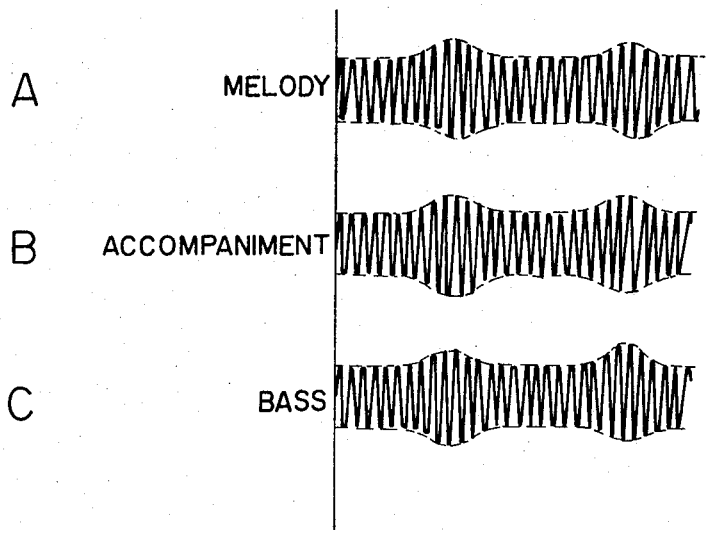
FIG. 6 shows waveforms obtained by a performance without accentuation by the instrument of FIG. 3.

The above mentioned accentuating effect is obtained only by a quick operation of expression pedal and usual or slow pressing-and-releasing operation of the expression pedal is for volume control without accentuation, because this operation does not produce any appreciable potential difference between Ⓐ and Ⓑ of FIG. 3 and all the voltage controlled amplifiers VCA1, VCA2 and VCA3 receive almost equal control voltages that will provide some trend of variations in the musical sounds. FIG. 6, A, B and C show waveforms of respective musical sounds in this case.

Figure 7:
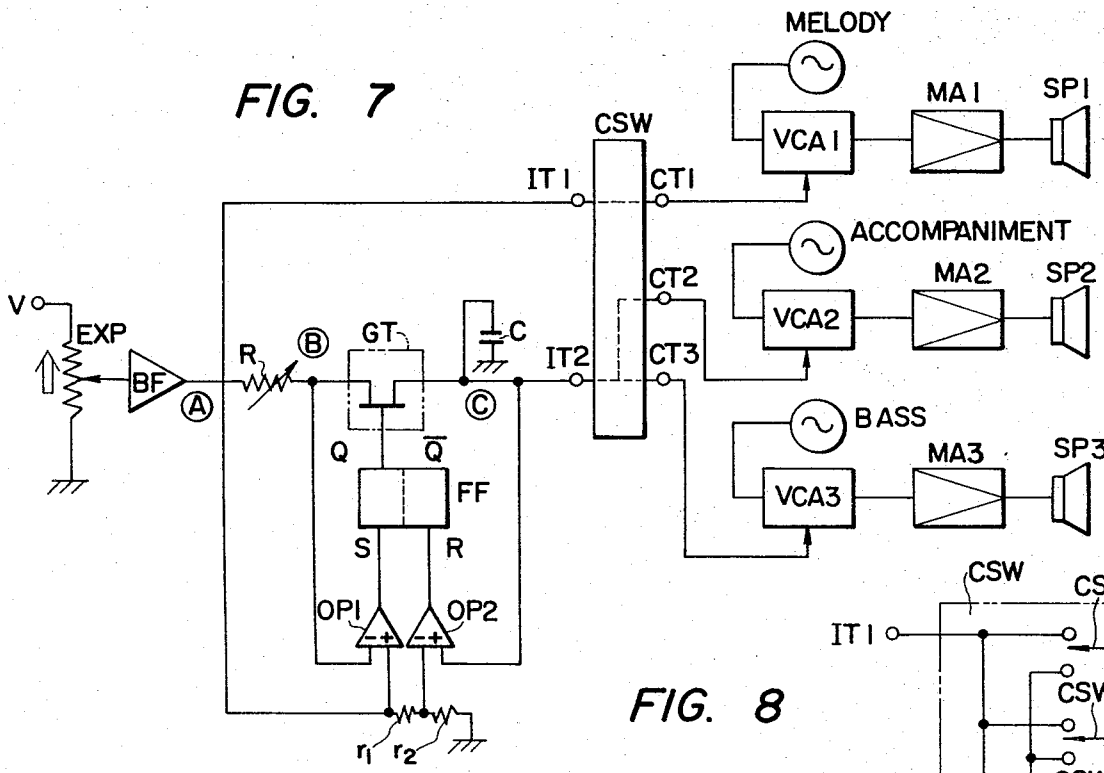
FIG. 7 shows a circuit configuration of a second embodiment of this invention.

FIG. 7 is a drawing illustrating the circuit configuration of a second embodiment of this invention. The same notations as those of FIG. 3 indicate the same or equivalent parts. Block CSW is a change-over switch, IT1 is a terminal connected with point Ⓐ in order to pick up a change in voltage introduced by a quick operation of expression pedal, IT2 is a terminal connected with point Ⓒ which keeps an almost constant voltage regardless of the quick operation of expression pedal, CT1, CT2 and CT3 are control terminals of voltage controlled amplifiers VCA1, VCA2 and VCA3. The change-over switch CSW is used for interconnection of IT1, IT2 and CT1-CT3.

At the initial setting, gate circuit GT is conductive, flip-flop FF is in its reset state with its Q output giving logic "0", terminal CT1 is connected to IT1 and terminals CT2 and CT3 are connected to a common terminal IT2 as shown by broken lines in the figure. Terminal Ⓐ is connected to IT1 and terminal Ⓒ is connected to IT2. During the time the gate circuit GT is conductive and the intermediate terminal Ⓑ and the output terminal Ⓒ of the time constant circuit are in the same potential. When this circuit is in its steady state, the input terminal Ⓐ is in equal potential to Ⓑ and Ⓒ and the said potential is the same as the buffer output voltage Vo associated with the sliding tap EXP position or the position of expression pedal before it is pressed down.

Figure 8:
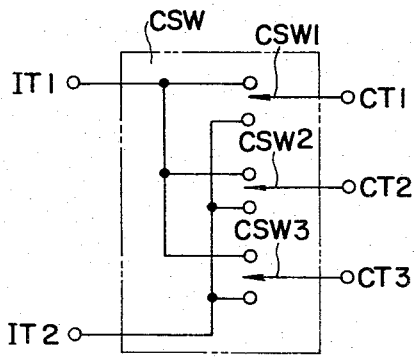
FIG. 8 is a drawing illustrating a detailed construction of changeover switch of FIG. 7.

Under this condition, the second embodiment operates in the same manner as that of FIG. 3 explained with reference to the time chart of FIG. 4. If the changeover switch CSW of this embodiment has the configuration of FIG. 8, selection of musical sounds with and without accent will be realized by operating switches CSW1, CSW2 and CSW3 associated with terminals CT1, CT2 and CT3, respectively.

In other words, the musical sound or sounds applied in the voltage controlled amplifier or amplifiers VCA connected with terminal IT1 may be accentuated, and those applied to the amplifiers connected with terminal IT2 are not accentuated. The construction of the change-over switch will be simplified by dividing the sounds applied to the voltage controlled amplifiers into two groups, i.e., the sounds entitled to be accentuated and the sounds not entitled to do so, and the voltage controlled amplifiers for the sounds entitled to be accentuated are made connectable to terminal IT1 and the voltage controlled amplifiers for the sounds not entitled to be accentuated are connected to IT2.

Thus, according to this embodiment, a mere addition of a relatively simple circuit can realize an immediate and simple switching function to discriminate a sound or sounds to be accentuated from those not to be accentuated on a quick operation of expression pedal. Furthermore, normal and slow pressing down gives a volume control common to all musical sounds, therefore the performance effect is extremely improved.

What we claim is:

1. A circuit for an electronic musical instrument comprising:

a plurality of voltage controlled amplifiers each receiving one of a plurality of music sources for amplifying them to provide musical sound;

means for developing a first control voltage which varies in response to an operation of pedal means, said first control voltage being fed to at least a first one of said voltage controlled amplifiers;

means for developing a second control voltage which varies in response to a relatively slow operation of said pedal means and is substantially unresponsive to a relatively rapid operation of said pedal means, said second control voltage being fed to at least a second one of said voltage controlled amplifiers;

whereby said second one of said voltage controlled amplifiers is substantially incapable of accentuating its associated music source in response to a relatively quick operation of said pedal means, said first and second control voltages being substantially equal in response to a relatively slow operation of said pedal means.

2. A circuit for an electronic musical instrument according to claim 1, wherein said means for developing said second control voltage comprises: a time constant circuit including a resistor and a capacitor that are connectable with each other through a switching means; means for supplying said first control voltage to an end of the resistor at the input side of the time constant circuit to charge said capacitor to provide a voltage at said capacitor; means for turning off said switching means to stop charging said capacitor when a voltage drop across said resistor exceeds a given value; and means for supplying said voltage at the capacitor to said second one of said voltage controlled amplifiers.

3. A circuit for an electronic musical instrument comprising:

a plurality of voltage controlled amplifiers each receiving one of a plurality of music sources for amplifying them to provide musical sounds, each of said voltage controlled amplifiers having a control terminal;

a first terminal receiving a first control voltage responsive to all operations of pedal means;

a second terminal receiving a second control voltage responsive to relatively slow operations of said pedal means and substantially unresponsive to relatively quick operations of said pedal means;

switching means provided between said first and second terminals and said control terminals, said control terminals being switched by said switching means to make connections with either of said first and second terminals to thereby vary in response to said pedal means the musical sound corresponding to the voltage controlled amplifier having control terminals connected to the first terminal, the musical sounds corresponding to the voltage controlled amplifier having control terminals connected to the second terminal being unresponsive to said pedal means when said pedal means is operated relatively quickly, and the first and second terminals providing substantially equal voltages when said pedal means is operated slowly.

4. A circuit for an electronic musical instrument according to claim 3, wherein said means for developing said second control voltage comprises: a time constant circuit including a resistor and a capacitor that are connectable with each other through a switching means, means for supplying said first control voltage to an end of the resistor at the input side of the time constant circuit to charge said capacitor to provide a voltage at said capacitor, means for turning off said switching means to stop charging said capacitor when a voltage drop across said resistor exceeds a given value, and a means for supplying said voltage at the capacitor to said second terminal.

* * * * *